US005413232A

United States Patent [19]

Bergner et al.

[11] Patent Number: 5,413,232

[45] Date of Patent: May 9, 1995

[54] PACK FOR POURABLE PRODUCTS

[75] Inventors: Rainer Bergner, Duesseldorf; Hubert Droessler, Erkrath; Siegfried Konkel, Duesseldorf; Volker Weiss, Langenfeld; Paul-Otto Weltgen, Hilden, all of Germany

[73] Assignee: Henkel Kommanditgesellschaft auf Aktien, Duesseldorf, Germany

[21] Appl. No.: 157,137

[22] PCT Filed: May 26, 1992

[86] PCT No.: PCT/EP92/01179

§ 371 Date: Dec. 6, 1993

§ 102(e) Date: Dec. 6, 1993

[87] PCT Pub. No.: WO92/21577

PCT Pub. Date: Dec. 10, 1992

[30] Foreign Application Priority Data

Jun. 4, 1991 [DE] Germany ..... 41 18 253.7

[51] Int. Cl.[6] ..... B65D 23/12

[52] U.S. Cl. ..... 215/398; 220/696; 220/759; 220/770; 229/103.2

[58] Field of Search ..... 215/100 R, 100 A; 220/696, 753, 756, 759, 770, 771, 662, 739; 229/40, 117.16, 117.13, 87.04

[56] References Cited

U.S. PATENT DOCUMENTS 2,888,179 5/1959 Daggett ..... 215/100 A
3,160,326 12/1964 Sturdevant et al. ..... 222/183
3,765,574 10/1973 Urquiza ..... 111/183
3,952,940 4/1976 Malcolm ..... 229/117.16 X
4,368,827 1/1983 Thompson ..... 215/100 A
4,397,393 8/1983 Pergande et al. ..... 220/117.13 X
4,796,937 1/1989 Andrea ..... 215/100 A X

FOREIGN PATENT DOCUMENTS 0406625 1/1991 European Pat. Off. .
3921258 1/1991 Germany .

*Primary Examiner*—Allan N. Shoap
*Assistant Examiner*—Christopher J. McDonald
*Attorney, Agent, or Firm*—Ernest G. Szoke; Wayne C. Jaeschke; Kenneth Watov

[57] ABSTRACT

A package for flowable goods includes an inner thin-walled plastic blown hollow body that receives the goods to be packaged and a supporting envelope without a bottom or a lid, with an upper stacking edge that surrounds the plastic hollow body and rests thereon in the packaging position. The plastic hollow body has a depression and the supporting envelope is provided with cut-outs that can be folded at least partially inward into the depression, that both act as fastening elements for the supporting elements, and form a handle for carrying the package. Engaging elements for the folded cut-outs are provided. In order to improve the link between the inner and outer package parts, the engaging elements form cams and are associated to an inclined projection formed in the plastic container in the pivoting area of the depression.

2 Claims, 4 Drawing Sheets

PACK FOR POURABLE PRODUCTS

BACKGROUND

1. Field of the Invention

The field of the present invention relates generally to packs for pourable products, and more particularly to such packs that consist of an inner container surrounded by a separable supporting jacket.

2. Discussion of Related Art

This invention relates to a pack for pourable products, such as liquids or free-flowing fine granules or the like, which consists of an inner thin-walled blown plastic container intended to hold the product and of a base- and cover-free supporting jacket with an upper supporting edge which surrounds the blown plastic container and bears against it in the in-use position of the pack, the blown plastic container preferably being provided with an upper bearing shoulder for resting on the supporting edge of the supporting jacket and comprising a recess. The supporting jacket is provided with laps which are designed to fold at least locally into the recess and to serve as fixing elements for the supporting jacket and which form a carrying handle, detent means being provided for the folded laps.

One such pack is known from applicants' DE 39 21 258 A1. In this known pack, the blown plastic container can be made by blow molding from a blow-moldable plastic so that the plastic content of the pack can be kept very small. The pack is made sufficiently stable by the supporting jacket of paper, cardboard, corrugated paper or a similar material. The handling properties are guaranteed by the recess in the container and the corresponding opening in the supporting jacket. In addition, optimal support of the plastic container is achieved via the upper supporting edge of the container on which the bearing shoulder of the blown plastic container rests in use. The two parts of the pack (blown plastic container and supporting jacket) are formed by the laps of the supporting jacket which are designed to be folded into the recess and which, folded together, also form the carrying handle of the pack.

With this known pack, it is readily possible by virtue of the design of the laps to join the two parts of the pack to one another and also to separate them from one another so that they may be separately recycled. After emptying the pack, the user may separate the two parts of the pack from one another and dispose of them separately. In particular, the outer supporting jacket of the pack may be disposed of as wastepaper. Although this known pack is thus very user- and recycling-friendly, it still has disadvantages. In the known pack, the connection between the two parts of the pack in its in-use state is still not entirely safe, as is necessary particularly when the pack is completely full.

SUMMARY OF THE INVENTION

Accordingly, an object of the invention is to provide a solution in which the connection between the inner and outer parts of the pack would be improved without any effect on the handling properties of the pack.

In a pack of the type mentioned above, the solution provided by the invention is characterized in that the detent means are in the form of cams which are integrally formed on at least one end of the handle laps of the supporting jacket, and with which a ramp-like projection formed on the plastic container is associated in the pivoting range of the recess.

This construction maintains the good handling properties of the pack and, at the same time, provides for a safe connection between the two parts of the pack, the blown plastic container and the surrounding supporting jacket. This is achieved by the combination of the cams on the handle laps, which form the detent means, and the ramp-like projection on the plastic container. At the same time, the presence of the ramp-like projection avoids a thin zone in the blown plastic container so that the other wall regions of the container are not unnecessarily overdimensioned.

In one advantageous embodiment of the invention, the ramp-like projection is in the form of a run-up ramp adapted to the pivoting range of the associated cam of the handle lap. This embodiment further improves the handling properties of the pack because the ramp-like projection is substantially exactly adapted to the pivoting movement of the associated cam of the handle lap so that the cam is guided during the pivoting movement. At the same time, the handle laps are able to pivot fully until they are in the fixed position, thus guaranteeing a safe connection of the two parts of the pack.

BRIEF DESCRIPTION OF THE DRAWINGS

The invention is described in more detail in the following with reference to the accompanying drawings, in which similar items are identified by the same reference designation, wherein.

DETAILED DESCRIPTION OF THE INVENTION

In the illustrated example of the invention, the pack globally denoted by the reference 1 consists of a blown plastic container 2 of substantially square or rectangular cross-section and a supporting jacket 3 of cardboard or similar material.

Figure 1:
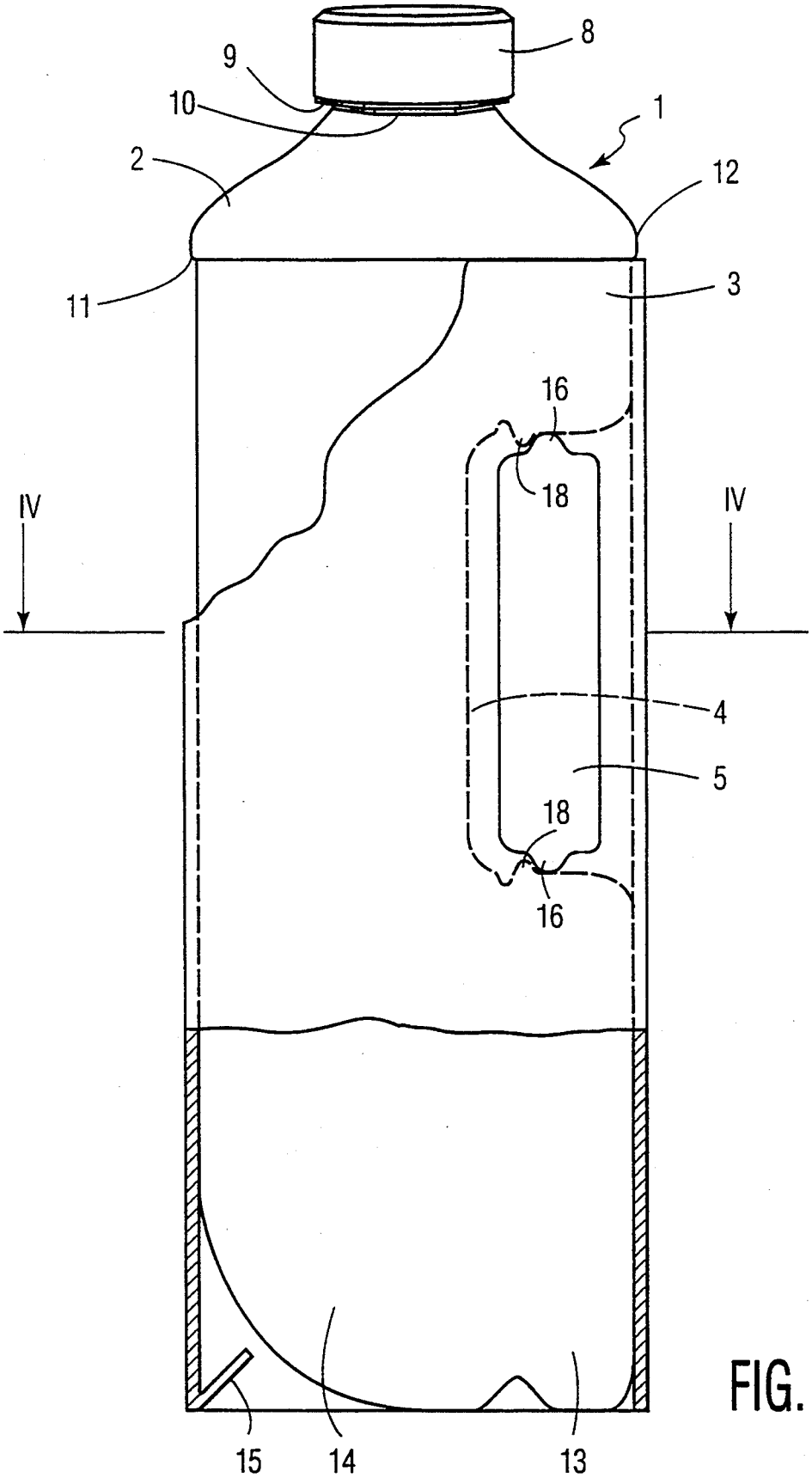
FIG. 1 is a side elevational view of the pack with the supporting jacket partly broken away.
Figure 2:
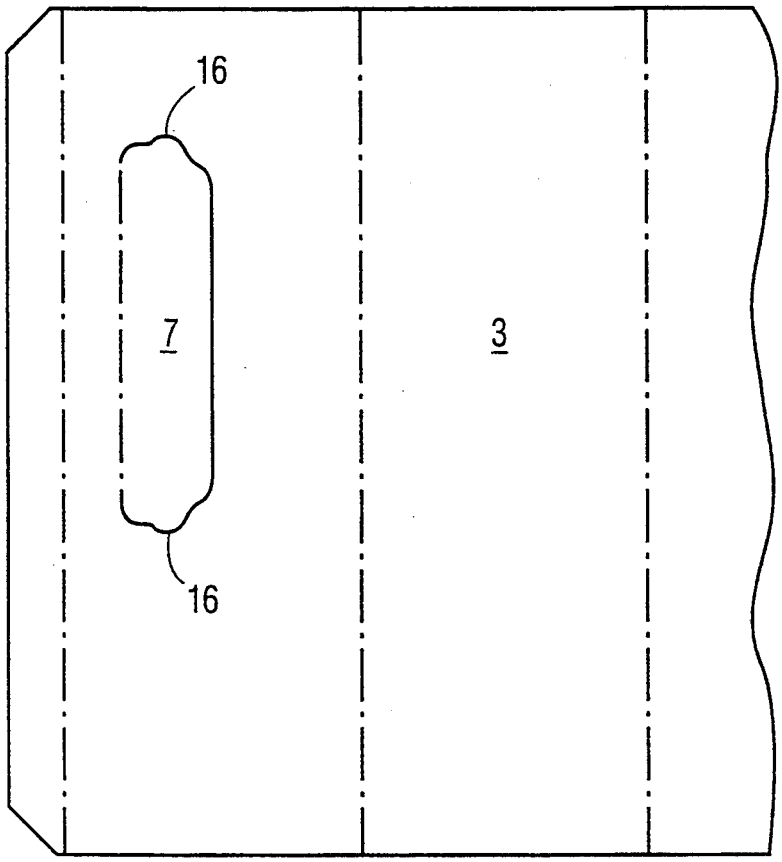
FIG. 2 shows a portion of a box blank for the outer supporting jacket of the pack.
Figure 3:
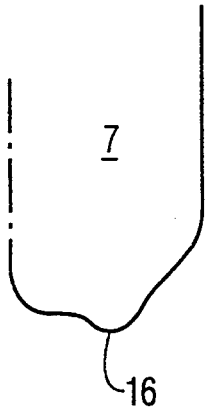
FIG. 3 is a detailed view of a handle lap according to FIG. 2 on a larger scale.

At one corner, the blown plastic container 2 is provided with a recess denoted by the reference 4 which is shown in chain lines in FIG. 1. Conversely, the supporting jacket 3 comprises two handle flaps 5 in this region, the corner denoted by the reference 6 being of multilayer construction so that parts of the punched-out flaps denoted by the reference 7 (FIGS. 2 and 3) are folded inwards and fixed. The manner in which they are fixed, which is crucial to the invention, will be described hereinafter.

In the region of the closure 8, the plastic container 2 has an upper encircling bearing shoulder 9 and support surfaces 10 which are hexagonal in shape in the illustrated example. The blown plastic container 2 is also provided with an upper bearing shoulder 11 which, in the in-use position, rests on the free edge 12 of the surrounding supporting jacket 3.

FIG. 1 shows two different designs of the base of the blown plastic container 2; reinforcing ribs 13 at bottom right and, on the left-hand side of FIG. 1, the base is partly spherical in shape, as denoted by the reference 14. In addition, the lower free edge of the supporting jacket 3 can be folded inwards, the corresponding flaps being denoted by the references 15 in FIG. 1. The flaps 15 are designed to hold the blown plastic container 2 in the supporting jacket 3.

The shape of the punched-out handle flaps 7 and the associated recess 4 crucial to the invention can best be seen from FIGS. 2 to 5. The handle flaps 7 of the supporting jacket 3 comprise cams denoted by the reference 16 which are integrally formed at both ends. These cams serve as detent means in conjunction with the special configuration of the recess 4. To this end, a ramp-like projection 18 in the form of a run-up ramp is formed in the pivoting range 17 of the recess 4 for the handle flaps 7 with the cams 16.

Figure 4:
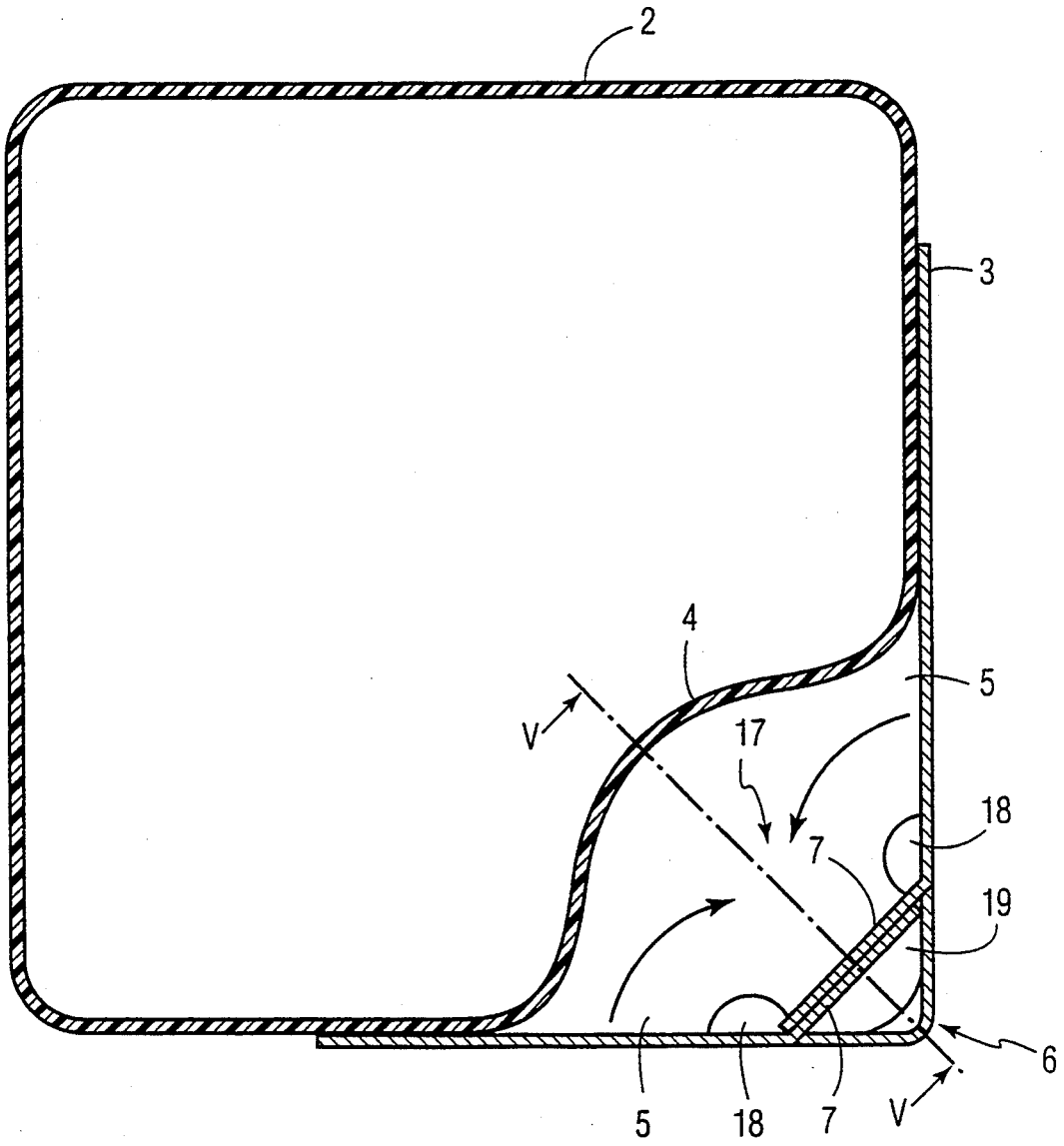
FIG. 4 is a section taken along the line IV—IV in FIG. 1.
Figure 5:
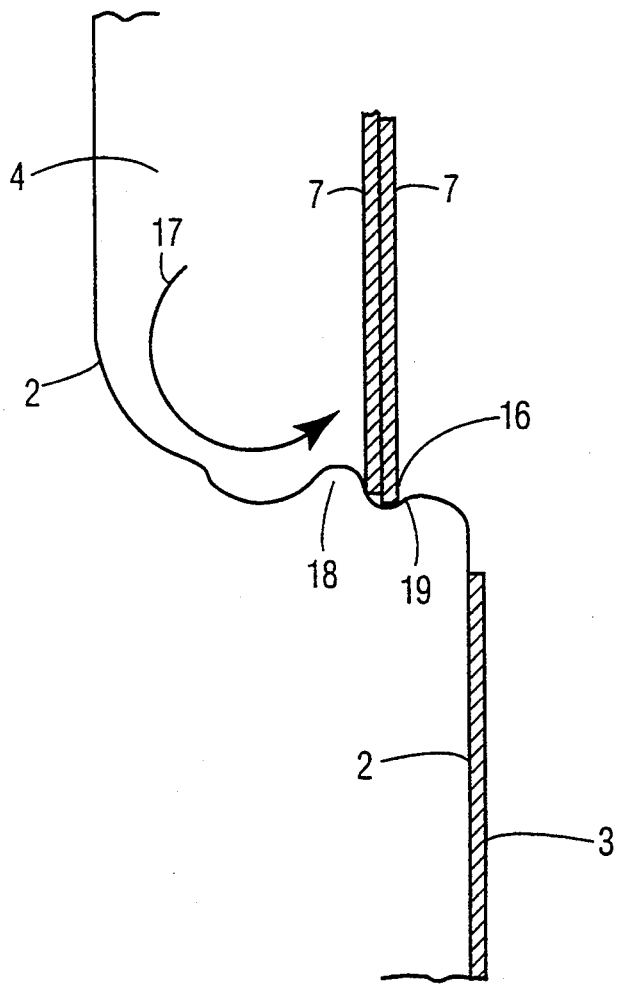
FIG. 5 is a simplified section taken along the line V—V in FIG. 4.

As can best be seen from FIGS. 4 and 5, the projection 18 tapers like a ramp and, at position 19 of the recess 4, forms a depression for the cams 16 of the folded handle flaps 7. This construction has the advantage that the cams 16 of the handle flaps 7 are guided along the ramp-like projection 18 during the pivoting movement along a path 17 and are then fixed easily in the depression.

This construction of the latching means (cams 16, ramp-like projection 18) provides for safe fixing between the blown plastic container 2 and the supporting jacket 3. At the same time, however, the two parts of the pack can easily be separated by withdrawal of the handle flaps 7.

The invention is not confined to the embodiments illustrated in the accompanying drawings. Further embodiments of the invention are possible without departing from the basic concept. Thus, the supporting jacket 3 may, if necessary, be of multilayer construction, etc. Also, other modifications to the illustrated embodiments of the invention may be recognized by those of skill in the art, which modifications are meant to be covered by the spirit and scope of the appended claims.

What is claimed is:

1. A pack for pourable products, such as liquids or free-flowing fine granules, comprising an inner thin-walled blown plastic container intended to hold the product, and a base- and cover-free supporting jacket with an upper supporting edge surrounding the blown plastic container and bearing against it in the in-use position of the pack, the blown plastic container being provided with an upper bearing shoulder for resting on the supporting edge of the supporting jacket, and including a recess, the supporting jacket being provided with flaps configured to fold at least locally into the recess and to serve as fixing elements for the supporting jacket, and for forming a carrying handle, latching means being provided for the folded flaps, said latching means being in the form of cams which are integrally formed on at least one end of said flaps of the supporting jacket, and with which a ramp-like projection formed on the plastic container is associated in the pivoting range for said flaps within the recess.

2. A pack as claimed in claim 1, wherein the ramp-like projection is in the form of a run-up ramp adapted to the pivoting path of the associated cam of the handle lap.

* * * * *